US007051657B2

(12) United States Patent
Yi et al.

(10) Patent No.: US 7,051,657 B2
(45) Date of Patent: May 30, 2006

(54) GROUP FIRING SYSTEM FOR FIREWORK UNIT

(76) Inventors: Li Yi, Taizishang Village, Dongfu Town, Liling City, Hunan (CN) 412205; Li Gang, Taizishang Village, Dongfu Town, Liling City, Hunan (CN) 412205

( * ) Notice: Subject to any disclaimer, the term of this patent is extended or adjusted under 35 U.S.C. 154(b) by 92 days.

(21) Appl. No.: 10/658,579

(22) Filed: Sep. 9, 2003

(65) Prior Publication Data

US 2004/0055493 A1 Mar. 25, 2004

(30) Foreign Application Priority Data

Sep. 10, 2002 (CN) ..... 2114392 A

(51) Int. Cl.
*C06C 5/04* (2006.01)
*F42B 4/26* (2006.01)

(52) U.S. Cl. ..... 102/275.7; 102/345; 102/360

(58) Field of Classification Search ..... 102/275.7, 102/275.9, 342, 345, 360; 89/1.816
See application file for complete search history.

(56) References Cited

U.S. PATENT DOCUMENTS

| | | | | | |
|---|---|---|---|---|---|
| 956,546 | A * | 5/1910 | Schulman | 102/361 |
| 1,666,598 | A * | 4/1928 | Hitt | 89/1.808 |
| 1,922,156 | A * | 8/1933 | Fabrizio | 102/357 |
| 3,227,084 | A * | 1/1966 | Stokes et al. | 102/361 |
| 3,535,809 | A * | 10/1970 | Hoffmann | 42/106 |
| 3,804,021 | A * | 4/1974 | McGirr | 89/1.41 |
| 4,063,485 | A * | 12/1977 | Carter et al. | 89/1.816 |
| 4,641,580 | A * | 2/1987 | Ogatsu | 102/217 |
| 5,342,225 | A * | 8/1994 | Farr | 439/817 |
| 5,429,053 | A * | 7/1995 | Walker | 102/342 |
| 6,393,990 | B1 * | 5/2002 | Fagan | 10/342 |
| 6,490,977 | B1 * | 12/2002 | Bossarte et al. | 102/342 |
| 6,899,033 | B1 * | 5/2005 | Marietta | 102/361 |

* cited by examiner

*Primary Examiner*—M. Clement
(74) *Attorney, Agent, or Firm*—Dorsey & Whitney LLP

(57) ABSTRACT

Group firing system for firework unit, wherein it has 1–2 paper fuse tubes, which are assembled with other shot tubes. While both ends of the paper fuse tubes have male socket and female socket, so each firework unit could be connected to a firework group through soft fuse hose which contains a fuse inside. There are two firing systems, i.e. series connection and parallel connection.

5 Claims, 5 Drawing Sheets

GROUP FIRING SYSTEM FOR FIREWORK UNIT

FIELD OF THE INVENTION

The present invention relates to a group firing system for connectable firework, which is in the field of pyrotechnics.

BACKGROUND OF THE INVENTION AND PRIOR ART

Fireworks as a kind of festivity products is enjoyed by people, especially, used in grand ceremony and ceremonial festival. It can not be replaced by any other forms, such as the light, sound, and color. The firing of the fireworks can not only strongly stand out a main subject, but also can leave endless imagination to each people. But such kind of firework-display party is limited by some professional conditions, thus, could not be realized by normal consumers. The main reason is that the conventional firework unit is unattached with each other. It could not be connected together by normal consumers.

Therefore, if we could change the structure of the firework unit, the consumer could operate the firework display party by themselves.

BRIEF DESCRIPTION OF THE INVENTION

The object of the present invention is to provide a new firing system for the firework unit. Thus, the consumers can arrange the firework display by themselves, then it could bring more attractive effect than before.

In one aspect, the present invention relates to a group firing system having a plurality of fireworks units, comprising:

the fireworks unit (A1, A2, A3, A4, . . . , B1, B,2, B3, B4, . . . , C1, C2, C3, C4, . . . ) each including a plurality of firing shot tubes (A, B, C, . . . ), the firing shot tubes having a firstly firing shot tube (A) and a final firing shot tube (T), the firing shot tubes connected with each other through inner fuses (7);

characterized in that, a lower fuse tube (2) and an upper fuse tube (2') disposed in each of the fireworks units;

each end of the lower and upper fuse tubes (2, 2') having a socket (3), the fuse tubes connected to each other with soft fuse hoses ($L_1$, $L_2$, $L_3$, $L_4$, . . . ) inserted in the sockets for forming the fireworks group each of the soft fuse hoses ($L_1$, $L_2$, $L_3$, $L_4$, . . . ) containing outer fuses;

a firstly fuse (6) provided in the lower fuse tube (2) and a final fuse (6') provided in the upper fuse tube (2'), in which the firstly fuse (6) linked with the inner fuse (7) from the firstly firing shot tube (A) and the final fuse (6') linked with the inner fuse (7') from the final firing shot tube (T).

Preferably, the lower fuse tube (2) positioned in a lower section of the fireworks unit, and the upper fuse tube (2') positioned in an upper section of the fireworks unit.

Preferably, a said soft fuse hose (L) containing the outer fuse inserted in one of the sockets (3) of the lower fuse tube (2) of a fireworks unit, a said soft fuse hose (L) containing the outer fuse inserted in one of the sockets (3) of the upper fuse tube (2') of the fireworks unit and inserted in one of the sockets (3) of the lower fuse tube (2) of the other fireworks unit, a said soft fuse hose (L) containing the outer fuse inserted in one of the sockets (3) of the upper fuse tube (2') of the other fireworks unit, so that the group firing system is connected in series attached fashion.

Preferably, a said soft fuse hose (L) containing the outer fuse inserted in one of the sockets (3) of the lower fuse tube (2) of a fireworks unit, a said soft fuse hose (L) containing the outer fuse inserted in the other socket (3) of the lower fuse tube (2) and inserted in one of the socket (3) of the lower fuse tube (2) of the other fireworks unit, a said soft fuse hose (L) containing the outer fuse inserted in the other socket (3) of the lower fuse tube (2) of the other fireworks unit, so that the group firing system is connected in parallel attached fashion.

In another aspect, the present invention relates to a fireworks unit, including a plurality of firing shot tubes (A, B, C, . . . ), the firing shot tubes having a firstly firing shot tube (A) and a final firing shot tube (T), the firing shot tubes connected with each other through inner fuses (7); characterized in that, a lower fuse tube (2) and an upper fuse tube (2') disposed in the fireworks unit;

each end of the lower and upper fuse tubes (2, 2') having a socket (3); a firstly fuse (6) provided in the lower fuse tube (2) and a final fuse (6') provided in the upper fuse tube (2'), in which the firstly fuse (6) linked with the inner fuse (7) from the firstly firing shot tube (A) and the final fuse (6') linked with the inner fuse (7') from the final firing shot tube (T).

With the structure mentioned, the conventional firework units can be fired in a group without the limitation of the place and the time. The consumer has more greatly enjoyable at sight of display fireworks.

1, shot tube; 2, lower paper fuse tube; 2', upper paper fuse tube; 3, sockets; 6, firstly fuse; 6', final fuse; 7,7', inner fuse.

$A_1$–$A_4$, $B_1$–$B_9$, $C_1$–$C_2$ indicate three kinds of fireworks unit with different shapes; $L_1$–$L_{14}$ indicate soft fuse hoses containing outer fuse.

DETAILED DESCRIPTION OF PREFERRED EMBODIMENTS

The present group firing system is developed on the conventional firework units to make it possible to connect the firework units for group display show.

The reason that we could carry out this system is that we have changed the firework' structure. It is composed of some shot tubes 1. It is installed with two lower and upper paper fuse tubes 2, 2'. And the structure between the paper fuse tube 2, 2' and the shot tube 1 as shown in FIGS. 2, 5, 6.

Figure 2:
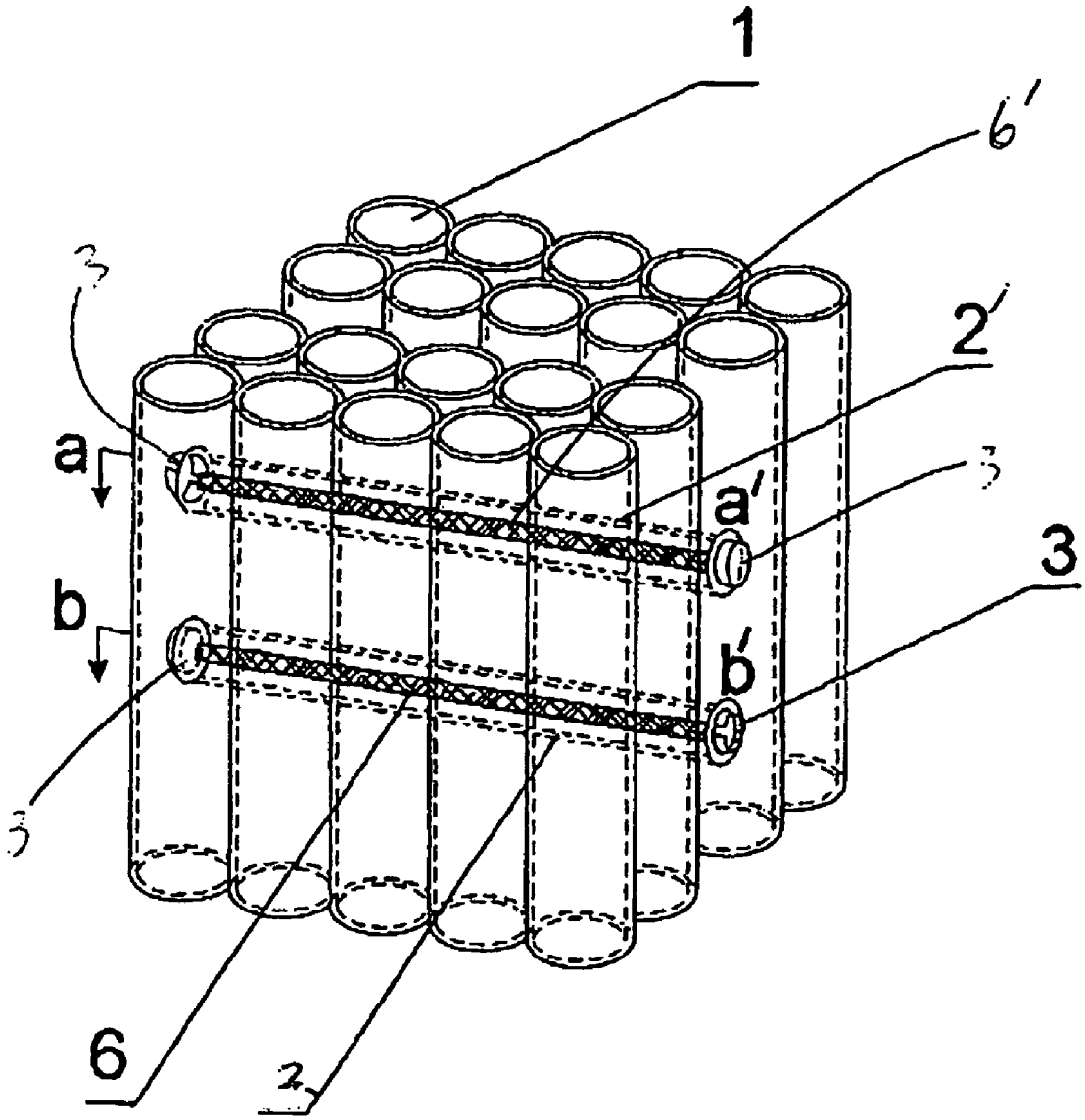
FIG. 2 shows inner structure of firework unit.
Figure 5:
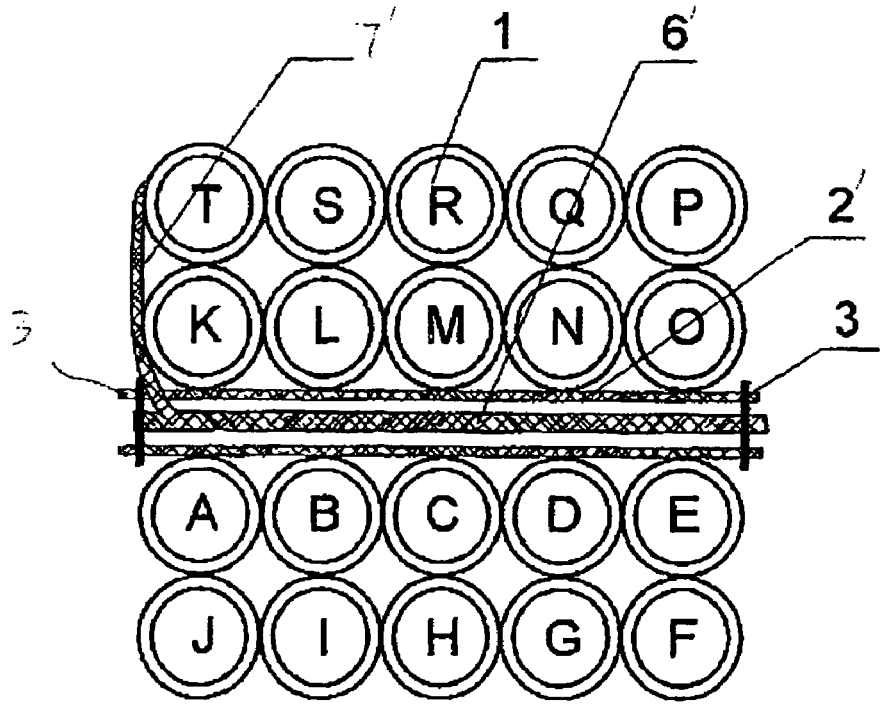
FIG. 5 shows the sectional view taken along line aa' in FIG. 2.
Figure 6:
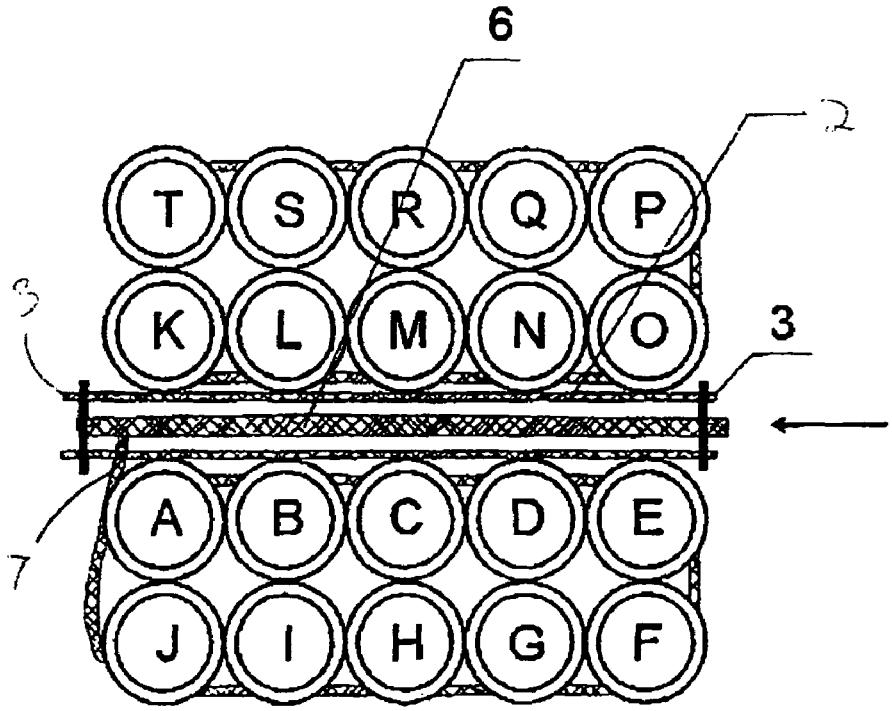
FIG. 6 shows the sectional view taken along line bb' in FIG. 2.

In particular, as shown in FIGS. 2, 5, 6, a fireworks unit includes a plurality of firing shot tubes 1 (A,B,C, . . . ). The firing shot tubes 1 has a first firing shot tube A and a final firing shot tube T. The firing shot tubes are connected with each other through inner fuses 7. A lower fuse tube 2 and an upper fuse tube 2' are disposed in the fireworks units. Each end of the lower and upper fuse tubes 2, 2' has a socket 3.

A first fuse 6 is provided in the lower fuse tube 2 and a final fuse 6' is provided in the upper fuse tube 2', in which the first fuse 6 is linked with the inner fuse 7 from the first firing shot tube A and the final fuse 6' is linked with the inner fuse 7' from the final firing shot tube T. In other words, the structure inside firework unit as we mentioned: its tubes are linked together as sequence A,B,C . . . R,S,T through inner fuse 7. And the first shot tube A links with the fuse 6 in the lower paper fuse tube 2 through the inner fuse 7, and the final shot tube T links with fuse 6' in the upper paper fuse tube 2' through the inner fuse 7'. With the above-mentioned structure of the fireworks unit, a basis connection system between the lower and upper paper fuse tube 2, 2' and the shot tubes 1 is obtained.

Figure 3:
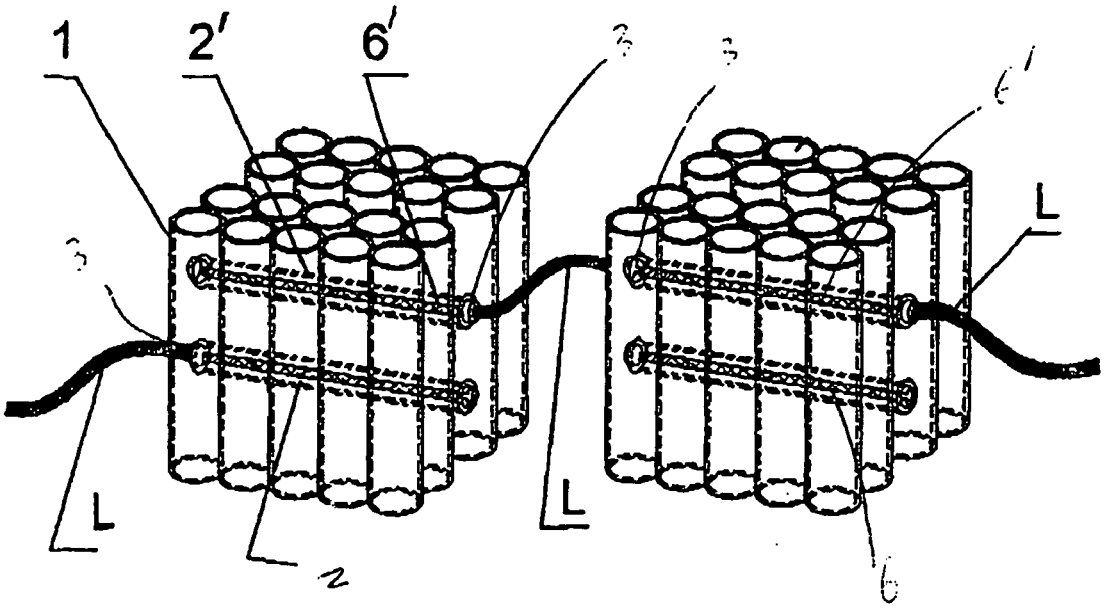
FIG. 3 shows the series connection structure.
Figure 4:
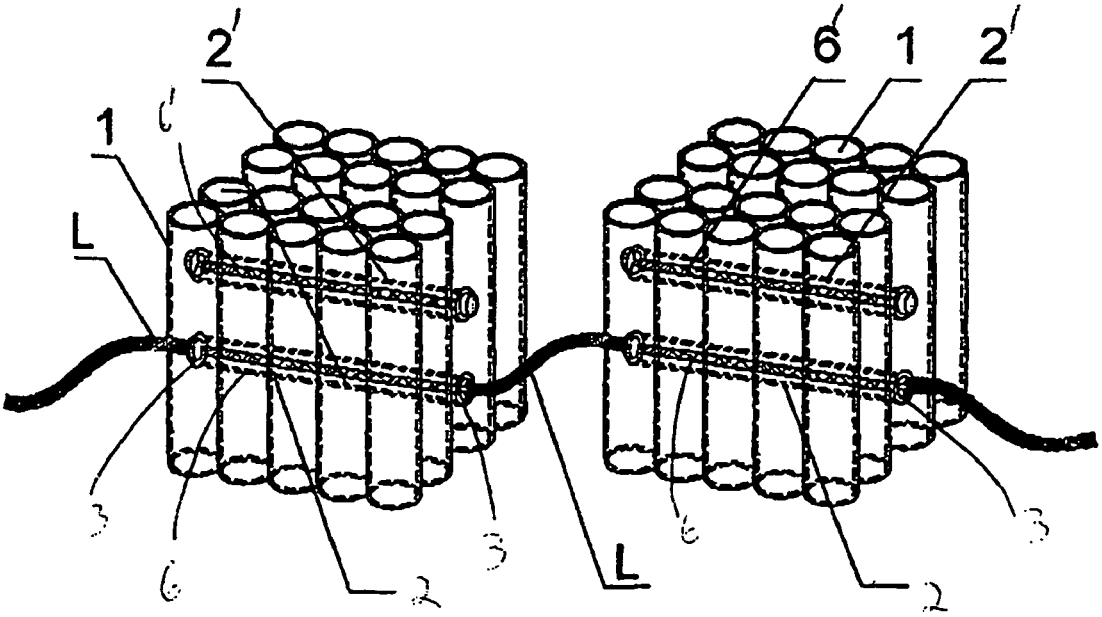
FIG. 4 shows the parallel connection structure.

As shown in FIGS. 3 and 4, there are two firing modes if the firework units with the above-mentioned structure are operated.

As shown in FIG. 3, two adjacent firework units link together with the lower paper fuse tubes 2 and the lower paper fuse tube 2' to be connected in series attached fashion. A soft fuse hose L contains an outer fuse is inserted in one of the sockets 3 of the lower fuse tube 2 of a fireworks unit, a soft fuse hose L containing the outer fuse is inserted in one of the sockets 3 of the upper fuse tube 2' of the fireworks unit and inserted in one of the sockets 3 of the lower fuse tube 2 of the other fireworks unit, a said soft fuse hose L containing the outer fuse is inserted in one of the sockets 3 of the upper fuse tube 2' of the other fireworks unit, so that the group firing system is connected in series attached fashion.

In this occasion, when the fuse 6 within the lower paper fuse tube 2 is fired, it transfers the fire through the inner fuse 7 from the first shot tube to the final shot tube (A to T), then, through the inner fuse 7' from the final shot to the fuse 6' in the upper paper fuse tube 2', to fire the soft fuse hose L containing outer fuse between the first fireworks unit and the next fireworks unit, to fire all of the shot tubes 1 (A to T) of the next fireworks unit. With this connection, several adjacent firework units can be fired one by one, that is, in series firing mode.

As shown in FIG. 4, two fireworks unit link together with the lower fuse tubes 2 to be connected in parallel attached fashion. A said soft fuse hose L containing the outer fuse is inserted in one of the sockets 3 of the lower fuse tube 2 of a fireworks unit, a said soft fuse hose L containing the outer fuse is inserted in the other socket 3 of the lower fuse tube 2 and inserted in one of the sockets 3 of the lower fuse tube 2 of the other fireworks unit, a said soft fuse hose L containing the outer fuse is inserted in the other socket 3 of the lower fuse tube 2 of the other fireworks unit, so that the group firing system is connected in parallel attached fashion.

In this occasion, when the fuse 6 within the paper fuse tube 2 is fired, it transfers the fire to the next firework unit through the soft fuse hose containing the outer fuse, and meanwhile, the shot tubes 1 (A to T) of the first fireworks unit by the inner fuse 7. Therefore, the adjacent fireworks units are fired simultaneously, that is, in a parallel firing mode.

Figure 1:
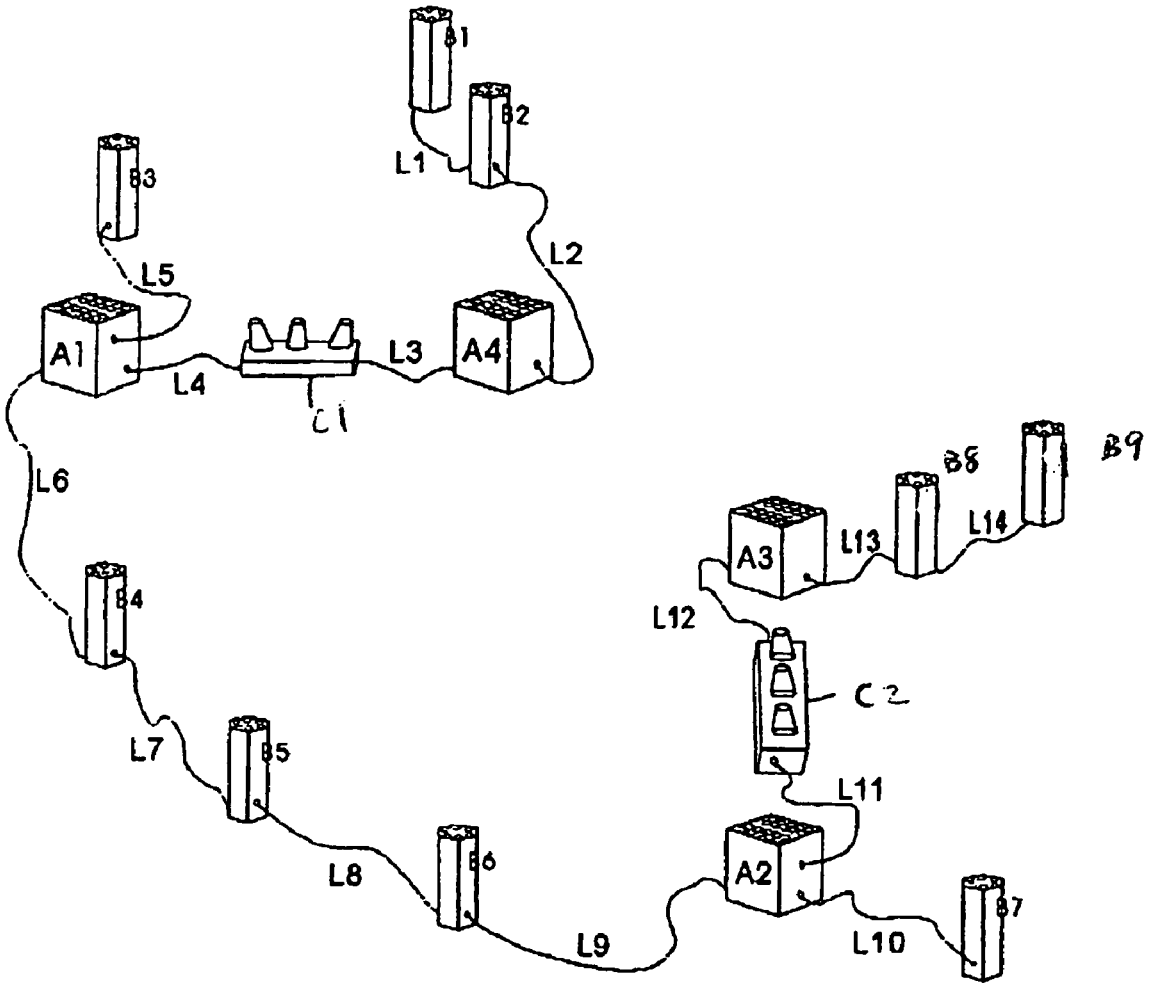
FIG. 1 shows the structure of this invention.

As shown in the attached FIG. 1, an embodiment of the group firing system of the present invention is illustrated. The connection firework group is composed of three sets of the different fireworks units $A_1$, $A_2$, $A_3$, $A_4$, $B_1$, $B_2$, $B_3$, $B_4$, $B_5$, $B_6$, $B_7$, $B_8$, $B_9$, $C_1$, $C_2$. These different firework units are linked by 1 to 2 paper fuse tubes 2,2' within their inner structure and some soft fuse hoses L with fuses outside to form a display group. If firework unit $B_1$ shown in the upper portion in the figure is taken as the first ignited firework in the group, it can be known that firework unit $B_1$ is serially connected with firework units $B_2$, $A_4$, $C_1$, $A_1$ through the paper fuse tubes and the soft fuse hoses $L_1$, $L_2$, $L_3$, $L_4$. Since $A_1$ has two paper fuse tube 2, 2', $L_4$ is connected to $B_4$, $B_5$, $B_6$, $A_2$ through soft fuse hose $L_6$, $L_7$, $L_8$, $L_9$ with the lower paper fuse tube 2', while $A_1$ is connected to $B_3$ through soft fuse hose $L_5$ with its upper paper fuse tube 2. By the same way, after the soft fuse tube $L_9$ is connected to $A_2$, it also is connected to $B_7$ through paper fuse tube) and $L_{10}$, at the same time, it is connected to $C_2$ through $L_{11}$ and upper paper fuse tube), and is connected to $A_3$, $B_8$, $B_9$ through $L_{12}$, $L_{13}$, $L_{14}$.

It can be known that the conventional firework units can be combined into various connection systems by changing the structure thereof, that is, it can be connected in series connection or parallel connection. The resulted firing pattern may be in block-shape or characters-shape.

Figure 7:
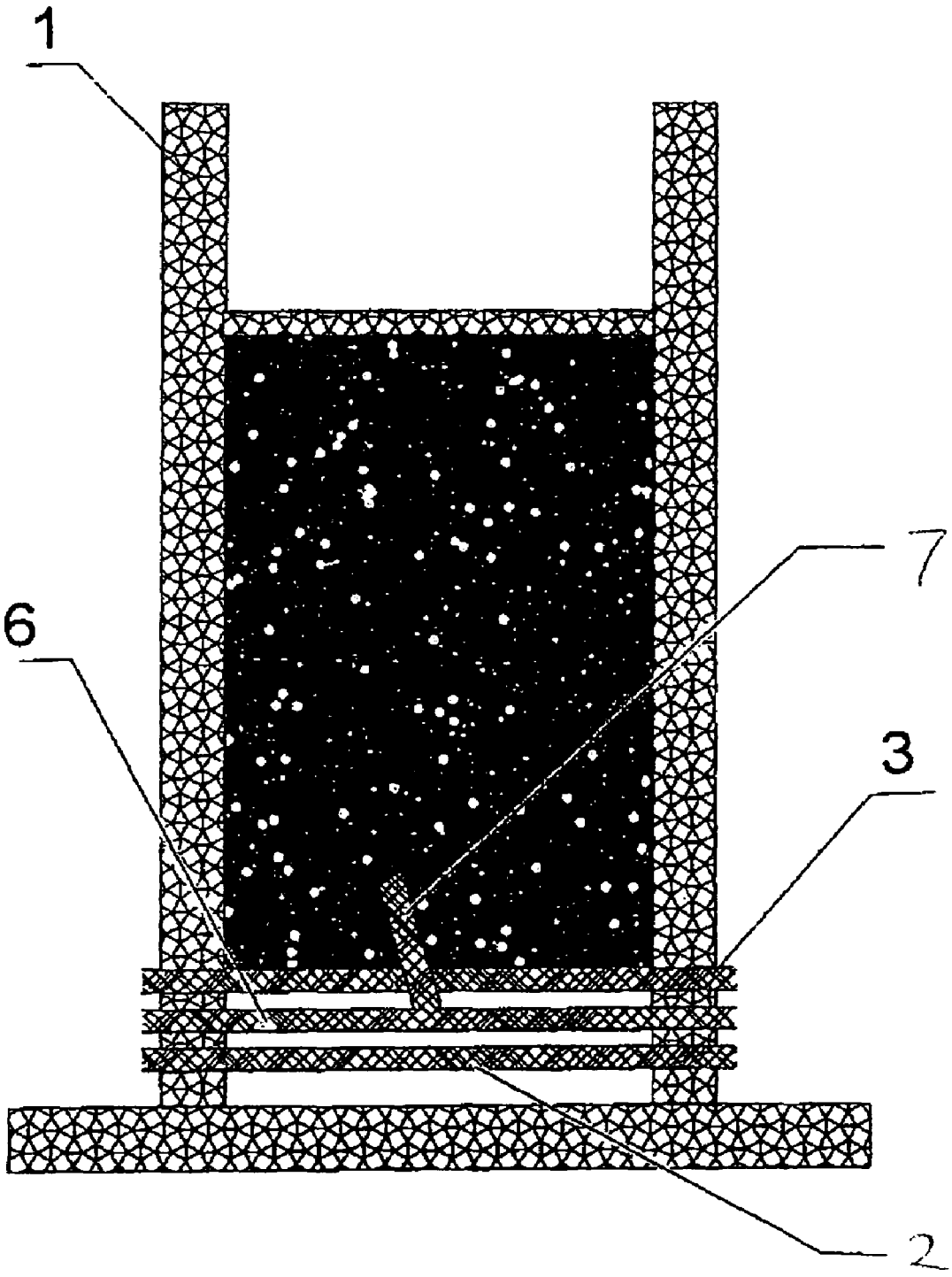
FIG. 7 shows the structure of firework unit provided with single one paper fuse tube.

Furthermore, the present invention would be the structure as shown in FIG. 7. In which, there is just one paper fuse tube in the fireworks unit, which is used to form series connection. Therefore, the fireworks unit with the one paper fuse tube is just fired together with the other fireworks units in parallel firing mode.

The invention claimed is:

1. A group firing system, comprising:

a plurality of fireworks units, each including a plurality of firing shot tubes, the firing shot tubes having a first firing shot tube and a final firing shot tube, the firing shot tubes connected with each other through a plurality of inner fuses; and wherein:

a lower fuse tube and an upper fuse tube are disposed in each of the fireworks units;

each end of the lower and upper fuse tubes has a socket, the fuse tubes connected to each other with a plurality of soft fuse hoses inserted in the sockets for forming a fireworks group, each of the soft fuse hoses containing a plurality of outer fuses; and a first fuse is provided in the lower fuse tube, and a final fuse is provided in the upper fuse tube, in which the first fuse linked with the inner fuse from the first firing shot tube and the final fuse linked with the inner fuse from the final firing shot tube.

2. The group firing system of claim 1, wherein the lower fuse tube is positioned in a lower section of the fireworks unit, and the upper fuse tube is positioned in an upper section of the fireworks unit.

3. The group firing system of claim 1, wherein each of the soft fuse hoses contains the outer fuse inserted in one of the sockets of the lower fuse tube of the fireworks unit, the soft fuse hose contains the outer fuse inserted in one of the sockets of the upper fuse tube of the fireworks unit and inserted in one of the sockets of the lower fuse tube of the other fireworks unit, the soft fuse hose containing the outer fuse inserted in one of the sockets of the upper fuse tube of the other fireworks unit, so that the group firing system is connected in series attached fashion.

4. The group firing system of claim 1, wherein the soft fuse hose contains the outer fuse inserted in one of the sockets of the lower fuse tube of the fireworks unit, the soft fuse hose contains the outer fuse inserted in the other socket of the lower fuse tube and inserted in one of the sockets of the lower fuse tube of the other fireworks unit, the soft fuse hose contains the outer fuse inserted in the other socket of the lower fuse tube of the other fireworks unit, so that the group firing system is connected in parallel attached fashion.

5. A fireworks unit, comprising:

a plurality of firing shot tubes, the firing shot tubes having a first firing shot tube and a final firing shot tube, the firing shot tubes connected with each other through inner fuses; and wherein:

a lower fuse tube and an upper fuse tube is disposed in the fireworks unit;

each end of the lower and upper fuse tubes has a socket; and a first fuse is provided in the lower fuse tube and a final fuse is provided in the upper fuse tube, in which the first fuse is linked with the inner fuse from the first firing shot tube and the final fuse is linked with the inner fuse from the final firing shot tube.

* * * * *